United States Patent [19]

Jones

[11] 4,280,444

[45] Jul. 28, 1981

[54] PROTECTIVE SHIELD FOR A BASEBOARD OR THE LIKE

[76] Inventor: Terry L. Jones, 827 E. 19th St., Owensboro, Ky. 42301

[21] Appl. No.: 61,429

[22] Filed: Jul. 27, 1979

[51] Int. Cl.[3] ..... B05C 21/00

[52] U.S. Cl. ..... 118/504; 15/257 R

[58] Field of Search ..... 15/257 R; 118/504

[56] References Cited

U.S. PATENT DOCUMENTS

| | | | |
|---|---|---|---|
| 2,538,743 | 1/1951 | Alston | 118/504 |
| 2,698,003 | 12/1954 | Bullock | 15/257 R X |
| 3,536,041 | 10/1970 | Hill | 118/504 |
| 3,693,589 | 9/1972 | Knox | 118/504 |

FOREIGN PATENT DOCUMENTS

| | | | |
|---|---|---|---|
| 1058568 | 7/1979 | Canada | 118/504 |
| 589707 | 6/1947 | United Kingdom | 15/257 R |

*Primary Examiner*—Edward L. Roberts

*Attorney, Agent, or Firm*—Warren D. Flackbert

[57] ABSTRACT

A shield having particular adaptability in protecting a baseboard or like member when painting or otherwise treating a surface thereabove characterized by a plate assembly mounted on vertically adjustable legs. A top plate of the assembly is removedly secured to a base plate received on the aforesaid legs, where the leading edge of the top plate is straight and undercut at an inclined angle in a cooperating relationship with the top of the baseboard to prevent an unwanted flow of paint or like material onto the baseboard during painting and/or other treating procedures.

2 Claims, 3 Drawing Figures

PROTECTIVE SHIELD FOR A BASEBOARD OR THE LIKE

As is known, and by way of example, a problem encountered with the painting of a wall or like surface, by both a nonprofessional and a professional, is the oftentimes drippage or splattering of paint onto the below positioned baseboard. Various techniques have been presented to overcome such a problem, including the usage of removable tape on the edge of the baseboard contiguous with the wall surface, and, as well, extreme patience and caution on the part of the worker to manually define the edge line between the wall surface and the top of the baseboard.

Each of the preceding examples has proven mostly defective, in that the tape does not necessarily assure a clean line of demarkation upon removal, due to some possible seepage problems and, additionally, even a skilled operator, with the proper type of brush and paint consistency, is presented some challenge in accomplishing the desired results without splattering or other paint run off.

Accordingly, a need has arisen for an alternative approach for accomplishing baseboard protection, and the invention satisfies such in presenting a vertically positionable horizontal plate assembly including the leading edge of a top plate thereof overlying the upper edge of the baseboard adjacent to the wall surface in a protective or shielding relationship.

More particularly, the aforesaid horizontal plate assembly further includes a base plate which is secured, for vertical movement, on upstanding adjustable legs. In other words, the baseboard protector or shield of the invention is arranged to accommodate various heights and/or outer configurations of baseboards or the like with the primary intent being the prevention of unwanted damage. As will be evident from the description herebelow, the aforesaid leading edge of the top plate is straight and undercut at an angle to further assist in usage and in defining a continuous stopping line for paint or other material flow or splattering. Moreover, the top plate is replaceable due to paint or like accumulation.

Figure 1:
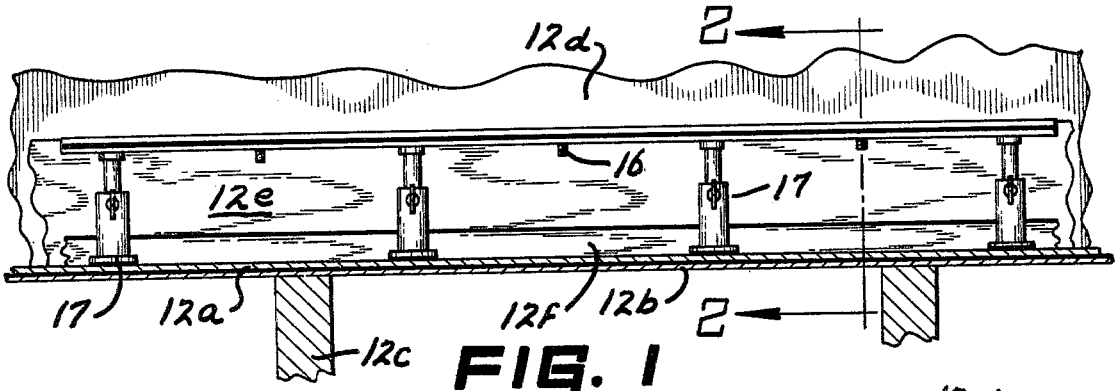
Figure 2:
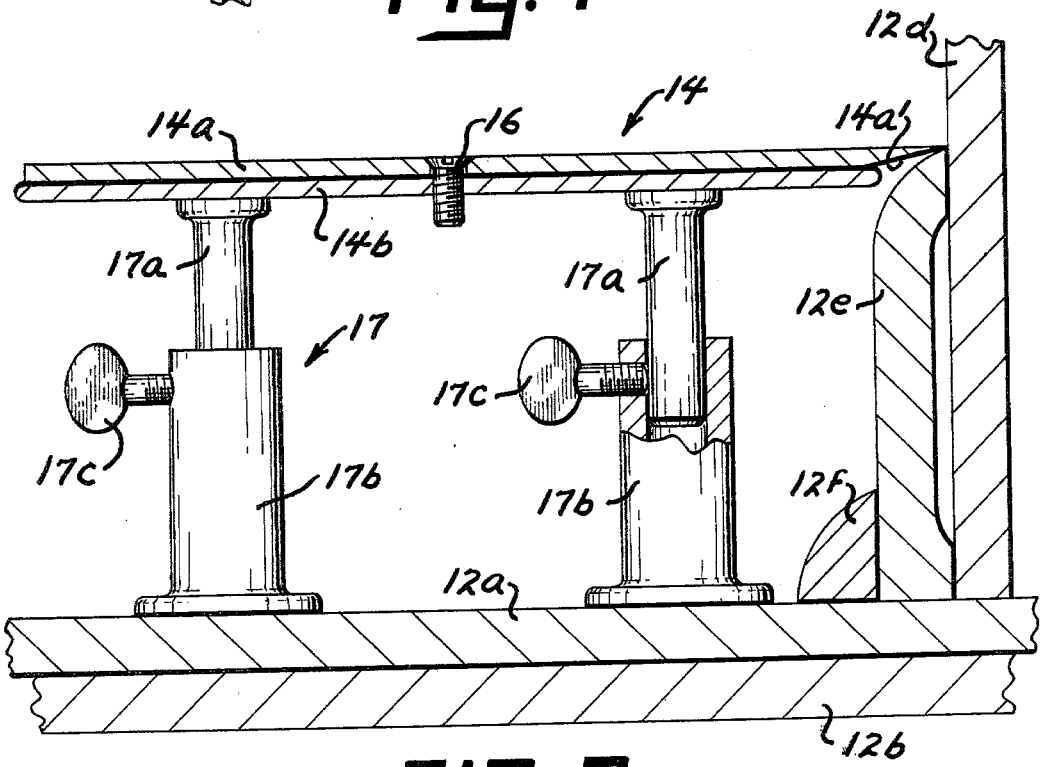
Figure 3:
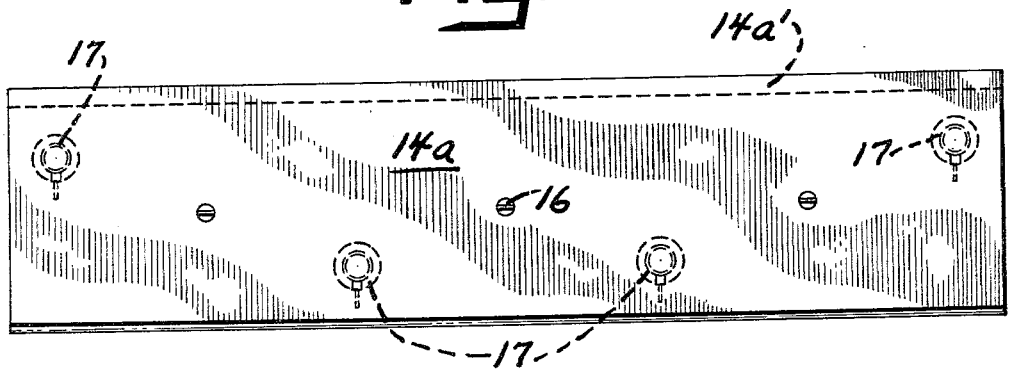

In any event, the invention is representative of a minimum number of components, is readily manufactured, and is effectively used at the desired site of operation, where a better understanding thereof will become more apparent from the following description, taken in conjunction with the accompanying drawing, wherein FIG. 1 is a view in elevation, showing a protective shield in accordance with the teachings of the invention in a typical installation;

FIG. 2 is a view in vertical section, taken at line 2—2 on FIG. 1 and looking in the direction of the arrows, showing details of the top plate in relation to a typical baseboard and, additionally, the vertical adjustment feature of the plate assembly; and, FIG. 3 is a top plan view of the invention, looking downwardly from the top to the bottom of FIG. 1.

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications of the illustrated device and such further applications of the principles of the invention as illustrated therein being contemplated as would normally occur to one skilled in the art to which the invention relates.

Referring now to the figures, the protective shield of the invention is shown installed for use at, for example, a painting site, i.e. in conjunction with, typically, flooring 12*a* and subflooring 12*b* supported on studding 12*c*, a vertical wall or like surface 12*d*, a conventional baseboard 12*e*, and the usual quarter round 12*f* covering the intersection of the bottom of the baseboard 12*e* with the flooring 12*a*. The baseboard 12*e* may be made from finished or unfinished wood, formed plastic or other desired material, where the wall 12*d* similarly can be formed from one of a variety of materials, such as, for example, plaster over laths, gypsum board, decorative wood, or synthetic paneling.

The invention is characterized by a plate assembly 14, typically rectangular in plan configuration, defined by a replaceable or interchangeable top plate 14*a* secured, by flush threaded screw means 16 (see FIG. 2), to a base plate 14*b*. As further evident in FIG. 2, the top plate 14*a* has a straight leading edge 14*a*′, typically undercut at an angle equal to or less than 12°, where the latter serves to define line contact in conjunction with the top of the baseboard 12*e*. The plates 14*a* and 14*b* are typically unitary polystyrene material, where the straight leading edge 14*a*′ of the top plate 14*a* may, in one invention embodiment, be composed of a width of tungsten material.

A plurality of legs 17, typically in two parts 17*a* and 17*b*, defining a telescopic relationship, each with an associated thumbscrew 17*c*, support the base plate 14*b*. In this connection, and by way of example, part 17*a* of each leg 17 may be integrally formed on the undersurface of the base plate 14*b* or may be suitably affixed thereto, as by threaded or adhesive means (all not shown). In any event, and as evident in FIG. 3, the legs 17 are arranged in a staggered relationship for reasons of unit stability.

In use, the protective shield presented by the invention is readily moved to the desired site of operation, where the legs 17 thereof rest on the surface, i.e. the flooring 12*a*, in the area adjacent the baseboard 12*e* (see FIG. 2). Importance lies in the fact that the plate assembly 14 may be adjusted vertically to accommodate baseboard height, through the release and tightening of the thumbscrews 17*c* which coact with the movable parts 17*a* of the legs 17.

Further importance lies in the fact that the top plate 14*a* is detachably secured to the base plate 14*b*, meaning ready replacement or interchanging of the former as paint or other material buildup occurs during the painting or processing operation. The illustrated dimensioning of the top plate 14*a* and the bottom plate 14*b* defining the plate assembly 14 is, of course, adaptable to change, i.e. the length thereof can be extended to accommodate a lesser or greater length of wall 12*d* and, hence, baseboard 12*e* expanse.

It should be evident, therefore, that the protective shield described hereabove affords a convenient approach to the covering of a baseboard 12*e* during the painting of an adjacent wall surface 12*d*. The adjustment feature permits customized usage to any height baseboard 12*e*, where the independent resting of the legs 17 on the flooring 12*a* or like supporting surface adjacent the baseboard 12*e* lends to ready and positive usage.

Modifications, other than those mentioned above, may be made to the protective shield in accordance with the teachings of the invention, including, for example, the particular type and arrangement of supporting legs, the manner of height adjustment of each supporting leg, and the like. Thus, the preceding should be considered illustrative and not as limiting the scope of the following claims:

I claim:

1. A protective paint shield for a baseboard disposed against an upstanding wall adjacent a floor comprising a plate assembly, and vertically adjustable legs disposed on said floor mounting said plate assembly to accommodate various heights of said baseboard, where said vertically adjustable legs are defined by a first part movable with respect to a second part and tightening means selectively securing said first and said second parts and said plate assembly at a preselected height of said baseboard, and where said plate assembly includes a detachable plate having a flat leading edge portion undercut to define a line of demarkation with the upper edge of said baseboard in an overlying shielding relationship and abutting said upstanding wall.

2. The protective paint shield of claim 1 where said vertically adjustable legs are disposed in rows defining a staggered pattern on said floor.

* * * * *